US006854732B2

(12) United States Patent
Moody

(10) Patent No.: US 6,854,732 B2
(45) Date of Patent: Feb. 15, 2005

(54) SIX DICE GAME

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 0 days.

(21) Appl. No.: 10/304,711

(22) Filed: Nov. 25, 2002

(65) Prior Publication Data

US 2003/0107172 A1 Jun. 12, 2003

Related U.S. Application Data

(60) Provisional application No. 60/336,623, filed on Dec. 7, 2001.

(51) Int. Cl.[7] ..... A63F 9/04
(52) U.S. Cl. ..... 273/274
(58) Field of Search ..... 273/274, 309, 273/146, 138.1

(56) References Cited

U.S. PATENT DOCUMENTS

| | | | | | |
|---|---|---|---|---|---|
| 5,133,559 | A | * | 7/1992 | Page | 273/274 |
| 5,350,175 | A | * | 9/1994 | DiLullo et al. | 273/146 |
| 6,234,482 | B1 | * | 5/2001 | Henderson | 273/274 |
| 6,273,423 | B1 | * | 8/2001 | Promutico | 273/274 |
| 6,286,834 | B1 | * | 9/2001 | Caputo | 273/274 |
| 6,601,848 | B1 | * | 8/2003 | Timmons, Sr. | 273/146 |

* cited by examiner

*Primary Examiner*—Benjamin H. Layno
(74) *Attorney, Agent, or Firm*—John Edward Roethel

(57) ABSTRACT

A dice game uses six dice. Each player makes a wager on the sum total of the six dice which would result from a single roll. A plurality of sum total groups are pre-established and a player makes a wager on one more of the sum total groups that can be achieved from a single roll of the six dice.

7 Claims, No Drawings

SIX DICE GAME

CROSS-REFERENCE TO RELATED APPLICATION

This application is based on and claims priority of U.S. Provisional Application Ser. No. 60/336,623, filed Dec. 7, 2001, entitled "Six Dice Game", now abandoned.

BACKGROUND OF THE INVENTION

This invention relates to a dice game, and more particularly to a dice game that uses six dice rolled a single time.

There have been many betting or wagering games that use dice. A conventional die has six sides with each side of the die having a one or more pips from one to six. The opposite sides of each die have pips that add up to seven.

Probably the most well known dice wagering game is Craps which is played using two standard six-sided dice. A player initially makes a PASS line wager on the first roll of the dice and winning PASS line wagers are paid even money (one-to-one odds on the amount of the wager). On the first roll, three possibilities are present-a roll of 7 or 11 is a winning roll, a roll of 2, 3 or 12 is a losing roll and a roll of any other number establishes a point to be made. If a point is made, the player continues to roll until either the point is rolled and the player wins his PASS line wager or a 7 is rolled and the player loses his PASS line wager.

The conventional game of Craps includes many other wagering opportunities based on the outcome of two dice being rolled. Some of the wagering opportunities involve a single roll of the two dice and some involve continual rolling of the two dice until some total is achieved or not achieved. For a complete description of Craps, reference is made to Scarne's New Complete Guide to Gambling, pages 259–336, the disclosure of which is incorporated herein. See also, Scarne on Dice, pages 64–65 for a discussion on how to figure the odds at Craps, pages 98–99 for an explanation of field bets and page 461 for a definition of a field bet, all of which are incorporated herein by reference.

Another well known dice game is YAHTZEE® which utilizes five dice. In this game, the player attempts to complete a chart which has a plurality of "hands" which may be formed from five or fewer dice. The player has a first roll of the five dice, saves whichever of the dice he thinks are helpful, re-rolls the remaining dice, again saves whichever of the dice are helpful and re-rolls the remaining dice. The player then uses the combination of the five resulting dice as his "hand" for that roll. The player marks on his chart the outcome of this hand.

The chart has a plurality of outcomes such as Five-of a-Kind, Four-of-a-Kind, Full House, Three-of a-Kind, Two Pair and a Chance outcome. The chance outcome is simply the sum of the five dice. When the game is completed, the player with the highest total score wins.

YAHTZEE® only uses five dice and, to achieve a "hand", a player may roll the dice up to three times.

It is an object of the present invention to provide an alternative dice game to Craps and to YAHTZEE® that can be played in a gaming establishment and that utilizes wagers made by the players, the outcome of which are determined by a single roll of six dice.

It is a feature of the present invention to have each player make a wager on the sum total achieved from a single roll of six dice. A plurality of sum total groups are established with odds associated with each sum total group. When the six dice are rolled, the pips on the top of each die are added up and the winning sum total group is determined. Players who have wagered on the winning sum total group are paid the corresponding odds relative to the amount of their wager and losing wagers are collected by the gaming establishment.

It is an advantage of the present invention that a dice game is provided that is much easier to understand than Craps and in which the player can receive larger odds payouts than are available in a conventional Craps game. The outcome of each game is determined by a single roll of the dice which makes the game much easier to deal and less likely to result in improper wagers and payouts.

Other objects, features and advantages of the present invention will become apparent from a consideration of the following detailed description.

SUMMARY OF THE INVENTION

A dice game uses six dice. Each player makes a wager on the sum total of the six dice which would result from a single roll. A plurality of sum total groups are pre-established and a player makes a wager on one more of the sum total groups that can be achieved from a single roll of the six dice.

DETAILED DESCRIPTION OF THE PREFERRED EMBODIMENTS

The method of the present invention involves a dice game using six standard dice, each die having six sides with pips from one to six. The basic play of the game is a single roll of all six dice. The sum total of the six dice is determined by adding up the pips exposed on the top side of each die after the dice have been rolled and the dice come to rest.

The method of the present invention can be played on a live gaming table that is provided with enough space to allow six dice to be rolled. Any suitable table size may be used; and the height and shape of the gaming table is not critical. In the preferred embodiment of the present invention, the gaming table should be large enough to allow at least six players to stand or sit around the perimeter of the gaming table so that they can participate in the play of the game by making wagers and rolling the dice. A location for a dealer is also provided as well as a chip rack for collecting and paying wagers. Other suitable equipment may be provided as needed, such as a drop box, as would be apparent to those skilled in the art. A conventional Craps table would suffice as an example of the type of gaming table that could be used.

The gaming table would be provided with a suitable layout that would provide each player with a location for placing wagers. Any suitable layout can be used.

The layout would also preferably include a pay table imprinted thereon or, alternatively, the pay table could be posted near the layout in any suitable manner.

In a preferred embodiment of the present invention, the pay table comprises a plurality of sum total groupings with different payout amounts associated with each of the sum total groupings. Any appropriate arrangement of the sum total groupings may be used which can be determined by analyzing the mathematical probability of the various sum totals that can be achieved when six dice are rolled.

An example of a suitable pay table is shown in Table 1.

TABLE 1

| | PAYOUT AMOUNT FOR COINS WAGERED | | | | |
|---|---|---|---|---|---|
| SUM TOTAL OF DICE | 9 | 18 | 27 | 36 | 45 |
| 6, 7 | 3000 | 5000 | 10000 | 14000 | 18000 |
| 8, 35 | 150 | 300 | 450 | 600 | 750 |
| 9, 10, 36 | 90 | 180 | 270 | 360 | 450 |
| 31, 32, 34 | 45 | 90 | 135 | 180 | 225 |
| 12, 30, 33 | 30 | 60 | 90 | 120 | 150 |
| 11, 14, 28 | 20 | 40 | 60 | 80 | 100 |
| 15, 16, 27 | 10 | 20 | 30 | 40 | 50 |
| 17, 18, 25, 26 | 7 | 14 | 21 | 28 | 35 |
| 19, 20, 21, 22, 23, 24 | 0 | 0 | 0 | 0 | 0 |
| 13, 29 | 85 | 170 | 255 | 340 | 425 |

The pay table shown in Table 1 has been calculated based on a casino game in which the players wager in increments of nine coins up to a maximum of forty-five coins. In order to encourage higher wagers, the payout amount for achieving a roll of six dice whose sum total is either 6 or 7 has been increased non-linearly when twenty-seven or more coins are wagered.

Any suitable pay table can be used based on the percentage game return that the gaming establishment wishes to offer the player. The mathematical probabilities of rolling the various sum totals using a single roll of six dice are easily calculable by those skilled in the art and the various sum total groupings can be selected as desired.

The method of play comprises a player making a wager on one or more of the plurality of sum total groupings that are offered in the pay table. The player makes this wager by placing wagering tokens, such as gaming chips, coins or cash money on the gaming table layout at the designated location for the player to make his wager. The player can wager on one of the sum total groupings, some of the sum total groupings or all of the sum total groupings.

Once all of the players have made their wagers, the six dice are rolled. The dice may be rolled by a designated player (as in conventional Craps) or the dice may be rolled by the dealer. If a designated player is used to roll the dice, the rolling of the dice may be passed sequentially or in any other suitable manner among the players at the gaming table. Alternatively, an electronic dice rolling device may be used to simulate the rolling of the six dice in a random manner and to display to all of the players and the dealer the results of the roll of the dice.

After the six dice have been rolled, the sum total of the six dice is determined and winning wagers are paid according to the pay table. Losing wagers are collected by the gaming establishment. For example, if the sum total of the six dice is 31 and the player has wagered twenty-seven coins on the grouping of 31-32-34, the player would be paid one hundred thirty-five coins.

Modifications may be made to the present invention. One modification would be to pay each player a bonus payout if special rolls of the dice were made. For example, if five-of a-kind were rolled, each player could be paid a bonus amount. The amount of the bonus could be based on the amounts wagered by the player or could be a flat amount regardless of how much a player had wagered. Other bonus payouts could be paid for other special rolls of the dice such as 1-2-3-4-5-6.

Another modification of the present invention would involve a preliminary roll of a portion of the dice before the players would make an additional wager on whether the resulting sum total of all six dice would be a high sum total or a low sum total. For example, three of the dice could be initially rolled and then each player would be given the opportunity to wager on whether the final sum total of all six dice would be high or low. Sum totals from 6 through 20 could be considered low totals and sum totals from 22 through 36 could be considered high totals. The sum total of 21 could be considered a losing wager for all bettors and thus provide the needed advantage for the gaming establishment.

This same high-low wager could be utilized after one, two or four dice are preliminarily rolled with the high-low outcome determined after all six dice have been rolled.

The method of the present invention has been described in connection with a live table game, but the method may also be played on an electronic video gaming machine that has been programmed to display a simulated roll of six dice. The computer controls of the electronic video gaming machine will add up the result of the roll of the six dice and determine which of the pre-established groupings of the sum totals is the winning grouping. A player makes a wager in any suitable manner which is conventional in electronic gaming machines by inputting the amount of the wager(s) and allocating each wager to the player's selected sum total grouping(s). Winning and losing wagers are determined by the computer controls and winning wagers are paid to the player in any suitable manner which is conventional in electronic gaming machines.

While the invention has been described with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a dice game using six conventional dice comprising the steps of:

a) randomly displaying one of the sides of a first portion of the six dice in a face up position;

b) after step a), allowing the player to make a wager on whether the sum total of all six dice will be a high number or a low number;

c) after step b), randomly displaying one of the sides of the remainder of the six dice in a face up position;

d) adding up the face up sides of all of the six dice to calculate the sum total of the six dice; and e) determining whether the sum total of the six dice is a high number or a low number.

2. The method of claim 1 in which the sum total of the six dice is a high number when the sum total is twenty-two or more.

3. The method of claim 1 in which the sum total of the six dice is a low number when the sum total is twenty or less.

4. The method of claim 1 in which the sum total of the six dice is a high number when the sum total is twenty-two or more and the sum total of the six dice is a low number when the sum total is twenty or less.

5. The method of claim 1 in which the first portion of dice is four dice.

6. The method of claim 1 in which the first portion of dice is two dice.

7. The method of claim 1 in which the first portion of dice is one die.

* * * * *